US005178750A

United States Patent [19]

Mead

[11] Patent Number: 5,178,750

[45] Date of Patent: Jan. 12, 1993

[54] LUBRICATING OIL PROCESS

[75] Inventor: Theodore C. Mead, Port Neches, Tex.

[73] Assignee: Texaco Inc., White Plains, N.Y.

[21] Appl. No.: 718,140

[22] Filed: Jun. 20, 1991

[51] Int. Cl.[5] ..... C10G 21/00; C10G 21/02

[52] U.S. Cl. ..... 208/309; 208/311; 208/314; 208/315; 208/318

[58] Field of Search ..... 208/309, 311, 314, 315, 208/318, 326

[56] References Cited

U.S. PATENT DOCUMENTS 4,328,092 5/1982 Sequeira, Jr. ..... 208/326

4,592,832 6/1986 Bristow et al. ..... 208/309

5,039,399 8/1991 Sequeira, Jr. ..... 208/311

*Primary Examiner*—Theodore Morris

*Assistant Examiner*—Walter D. Griffin

*Attorney, Agent, or Firm*—Jack H. Park; Kenneth R. Priem; Richard A. Morgan

[57] ABSTRACT

An improvement has been found in a process for producing Bright Stock from petroleum residuum by propane deasphalting and solvent refining. The extract of solvent refining is cooled to yield an aromatics-lean secondary raffinate which is recycled to propane deasphalting. An improved yield of Bright Stock is achieved over recycling extract to propane deasphalting.

12 Claims, 1 Drawing Sheet

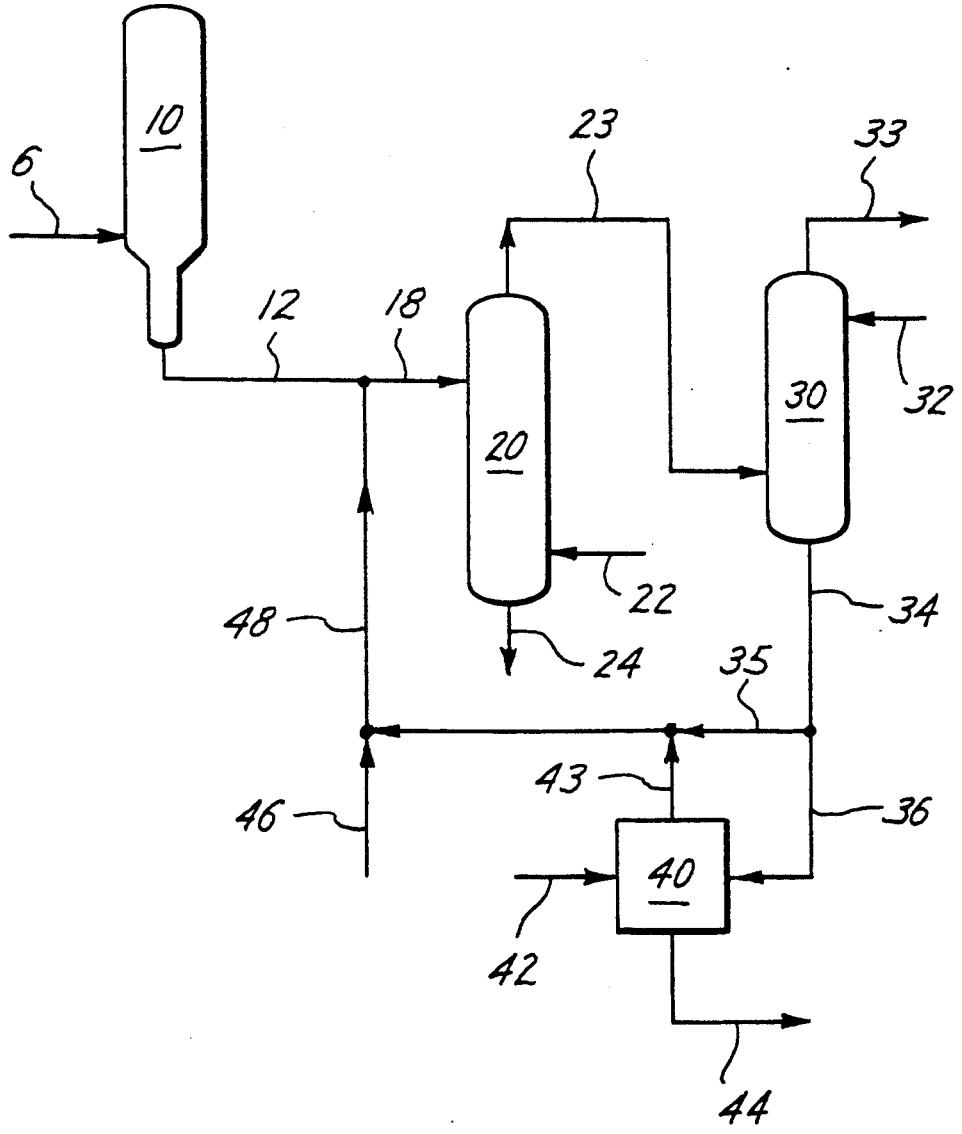
10
6
12
18
23
33
20
30
32
22
24
34
48
35
43
46
36
40
42
44

LUBRICATING OIL PROCESS

FIELD OF THE INVENTION

This invention relates to the manufacture of lubricating oils. More particularly the invention relates to a lubricating oil process comprising solvent deasphalting and solvent extraction. Most particularly the invention relates to improving the yield of lubricating oil from a petroleum residuum oil.

DESCRIPTION OF THE RELATED ARTS

It is well-known that a petroleum vacuum residuum fraction boiling above about 900° F. can be processed to extract a lubricating oil. The lubricating oils produced from this fraction are referred to as Bright Stock which is blended with other lubricating base oils to yield lubricating oil products such as gear oil, machine oil, automobile engine oil, etc.

Generally, a crude petroleum suitable for lube oil production is fractionated to remove liquid fuel and lighter fractions such as light gas oil, gasoline, diesel oil and kerosene collectively having a boiling range of 360° F. to 600° F. to 650° F. Gas oil and vacuum gas oil fractions are removed by atmospheric and vacuum distillation. These fractions have an initial boiling point of 600° F. and a nominal end point of about 900° F. The bottoms product of vacuum distillation is the feedstock for the present lubricating oil process. This petroleum vacuum residuum has an initial boiling point of approximately 900° F. and boils over a range exceeding 1000° F.

Petroleum vacuum residuum feedstocks which are suitable for the manufacture of lubricating oils are deasphalted by contacting and extracting with a propane solvent to remove a number of undesirable, heavy components collectively referred to as asphaltic residue. The resulting extract oil is extracted with a solvent selective for aromatics, such as N-methyl-2-pyrrolidone to remove aromatic hydrocarbons. The resulting deasphalted, solvent extracted oil containing mainly paraffinic hydrocarbons is referred to as Bright Stock raffinate oil.

Bright Stock raffinate oil is subjected to dewaxing to remove heavier paraffinic hydrocarbons which can precipitate at reduced temperature. The oil is then subjected to a mild catalytic hydrogenation, referred to as hydrofinishing to improve the color and color stability of the oil. The resulting oil is referred to in the art as the above-mentioned Bright Stock which is used as a lubricating oil blending stock.

U.S. Pat. No. 4,592,832 to D. J. Bristow et al. teaches a process for increasing Bright Stock raffinate oil production. A vacuum residuum fraction is subjected to propane deasphalting and solvent extraction. The extract of solvent extraction is returned to the propane deasphalter. The raffinate of solvent extraction is Bright Stock raffinate oil.

U.S. Pat. No. 3,929,616 to T. C. Mead et al. teaches the manufacture of lubricating oils. A vacuum residuum is subjected to solvent extraction, solvent extraction, hydrocracking, deasphalting and dewaxing to produce a lubricating oil.

SUMMARY OF THE INVENTION

The invention is a process for improving the yield of lubricating oil from a petroleum residuum oil. The petroleum residuum is first contacted with a deasphalting solvent, at deasphalting conditions in a deasphalting zone to yield a deasphalted lube oil and an asphaltic residue. The deasphalted lube oil is separated from asphaltic residue.

The deasphalted lube oil is extracted with a solvent selective for aromatics at solvent extraction temperature and conditions to yield an aromatics-lean primary raffinate comprising lubricating oil and an aromatics-rich primary extract. The primary raffinate is separated from primary extract.

Primary extract is cooled to a temperature below the extraction temperature, thereby forming an aromatics-lean secondary raffinate and an aromatics-rich secondary extract.

Secondary raffinate is separated and passed to the deasphalting zone. As a result the recovery of lubricating oil from petroleum residuum is increased.

The process is particularly useful for producing Bright Stock when the supply of petroleum residuum is limited and there is additional capacity in the deasphalter to process feedstock.

BRIEF DESCRIPTION OF THE DRAWING

The Drawing is a simplified process flow diagram for carrying out the invention.

DESCRIPTION OF THE PREFERRED EMBODIMENTS

The process of the invention is described with reference to the Drawing.

Crude petroleums which yield a residuum suitable for manufacturing lubricating oils are well-known in the art. For example West Texas, Penn., Mid-Continent, Arabian and other paraffinic crude oils are flowed via line 6 to fractionation tower 10. Tower 10 is representative of equipment including a crude oil desalter, atmospheric distillation tower and vacuum distillation tower which produce as a bottoms product a paraffinic petroleum residuum fraction via line 12. This fraction contains materials boiling in the lube oil range, generally at an initial boiling point of about 900° F. To obtain a high viscosity index lubricating oil product, the viscosity index of this residuum is preferably at least about 70, but the process is not limited to such fractions. Residuum having viscosity indexes of 50 and even lower may be used successfully to produce high viscosity index products using more severe processing conditions.

The paraffinic petroleum residuum fraction is passed via lines 12 and 18 to deasphalting tower 20, substantially the entire volume of which contains a deasphalting zone. Deasphalting is a liquid-liquid extraction carried out by contacting the residuum with a low molecular weight paraffin deasphalting agent such as propane, normal butane, isobutane or pentane introduced via line 22. The countercurrent contacting is carried out at deasphalting conditions, generally at a temperature in the range of 100° F. to 250° F., a dosage of from 400 to 1000 vol % solvent/oil and a pressure of about 200 to 1000 psig. The actual deasphalting conditions chosen are dependent on the solvent. That is, the temperature chosen should not exceed the critical temperature of the solvent and the pressure is maintained above the autogenous pressure to prevent vaporization. Asphalt and associated solvent soluble materials collectively described as asphaltic residue are removed from deasphalting tower 20 via line 24.

A deasphalted lube oil is withdrawn via line 23. Deasphalting agent is removed by evaporation and stripping (not shown) and the solvent free deasphalted lube oil is passed to solvent extraction contactor 30.

In solvent extraction the deasphalted lube oil is subjected to liquid-liquid contacting with a solvent introduced via line 32 which is preferentially selective for aromatic constituents of the charge. It is characteristic of such extraction solvents that they are partially miscible with the deasphalted lube oil being treated so that during the extraction, two phases are formed: an aromatics-lean primary raffinate phase containing substantially only a solvent refined material having a reduced amount of aromatics as compared to the charge stock with a small amount of solvent and an aromatics-rich primary extract phase containing substantially more aromatics than the charge stock with most of the solvent. The solvent refining step may be carried out batchwise, but is typically carried out continuously in a contacting apparatus such as a packed or plate tower or a rotating disc contactor either concurrently or countercurretly.

The contacting is carried out at a temperature above about 75° F., and below the boiling point of the solvent, preferably about 50° F. below the boiling point. The temperature must be below the temperature of complete miscibility of the charge in the solvent. Ordinarily an extraction temperature between 75° F. and 375° F. is employed and a solvent dosage within the range of about 50 vol % to 500 vol % solvent/oil, typically 100 vol % to 200 vol %. Furfural, N-methyl-2-pyrrolidone and phenol are the preferred solvents for solvent refining including water mixtures thereof.

The aromatics-lean primary raffinate phase is withdrawn via line 33 and subjected to stripping to remove residual oil (not shown). This composition is referred to as Bright Stock raffinate oil. This oil is subjected to dewaxing, either catalytic dewaxing or solvent dewaxing, to remove heavier normal paraffins.

In catalytic dewaxing the deasphalted lube oil is passed through a bed of pelleted catalyst comprising a hydrogenating component such as is used in the hydrocracking catalyst in substantially the sam amounts supported on a decationized mordenite which has been composited with an amorphous inorganic refractory oxide such as silica or alumina. In the preparation of the support, synthetic mordenite is treated with a dilute acid such as 6N HCl to the extent that a portion of the alumina is leached out of the mordenite to produce a mordenite having a silica:alumina mole ratio of at least 20 and is then mixed with the amorphous oxide. The catalytic dewaxing may be carried out at a temperature of at least 450° F., a pressure of at least 100 psig, and a space velocity of from 0.2 to 5.0 v/v/hr. in the presence of hydrogen introduced at a rate between about 1000 and 10,000 SCF/bbl. Preferred conditions are a temperature of 490° F. to 850° F., a pressure between 100 and 1500 psig, a space velocity between 0.2 and 1.0 v/v/hr. with a hydrogen rate between 3000 and 8000 SCF/bbl.

Solvent dewaxing is carried out by contacting the deasphalted, solvent-extracted oil with a dewaxing agent such as a mixture of dichloromethane and dichloroethane or a mixture of a ketone such as acetone, methyl ethyl ketone or methyl isobutyl ketone and an aromatic hydrocarbon such as benzene or toluene in a ratio of from 3 to 5 parts by volume of solvent per volume of oil and cooling the oil dewaxing agent mixture to a temperature of from about 0° F. to 10° F. below the desired pour point of the dewaxed oil. The waxy components are then removed by filtering or centrifuging. If desired, the filtrate or supernatant liquid may be subjected to an additional wash with solvent prior to stripping for removal of the residual solvent. The preferred solvent is a mixture composed of 50 vol % methyl ethyl ketone and 40 vol % toluene used at a solvent:oil ratio of 4:1 followed by a wash using a solvent:oil volume ratio of 3:1.

Dewaxing is followed by a mild catalytic hydrogenation referred to in the art as hydrofinishing to remove sulfur and improve color and color stability. Hydrofinishing is carried out at a temperature of 500° F. to 600° F. at hydrogen rate of 70 to 100 SCF/bbl and hydrogen pressure of 500 to 1000 psig. Catalysts which are well-known for hydrofinishing include one or more metals of Groups VIB and VIII of the Periodic Table of Elements or sulfides or oxides thereof on an alumina support. These metals include molybdenum, chromium, tungsten, platinum, nickel, iron and cobalt. These catalysts are commercially available.

The resulting product oil is referred to as Bright Stock.

The aromatics-rich primary extract phase is withdrawn via line 34 and passed via line 36 to decanter 40. To assist in effecting the separation in the decanter, primary extract phase is cooled and may be mixed with an antisolvent introduced via line 42. The antisolvent is mixed with primary extract in a preferred amount of 0.1 vol % to 10 vol %. The antisolvent, also known as a solvent modifier, is selected from a class of compounds which are characterized as being only slightly soluble in paraffinic mineral oils and which is substantially completely soluble in the extraction solvent. In industrial practice the preferred antisolvent is water. Additional antisolvents include alcohols and glycols. Specific examples of effective antisolvents include glycerine, ethylene glycol, diethylene glycol, formamide and methyl alcohol.

The primary extract-antisolvent mixture is cooled to a temperature sufficiently lower than the temperature in the extraction contactor 30 to form two immiscible liquid phases in the decanter. Cooling to a temperature 10° F. to 120° F. below the temperature in the bottom of extraction contactor 30 results in the formation of two liquid phases which are separated from one another by gravity in decanter 40.

The lower phase, termed secondary extract, contains extraction solvent, antisolvent and oil relatively richer in aromatic content than the primary extract phase. Secondary extract is withdrawn via line 44, freed of solvent and used commercially for its aromatic content. For example it may be routed to the liquid fuel oil pool, used as a rubber processing oil or otherwise applied for processing based on its aromaticity.

The upper phase, termed secondary raffinate is withdrawn via line 43 and subjected to solvent removal, primarily stripping, (such as that described in U.S. Pat. No. 4,294,689). Secondary raffinate is intermediate in quality; as measured by refractive index or viscosity index, between deasphalted lube oil in line 23 and primary extract in line 34. Applicant has discovered that by recycling secondary raffinate via lines 43, 48 and 18 to the deasphalting zone in deasphalting tower 20 that an increased amount of deasphalted lube oil is recovered in line 23. The amount of lubricating oil recovered in line 33 is also increased. The amount of lubricating oil is also improved over the recycle of primary extract via lines 34, 35, 48 and 18 to the deasphalting tower 20 which is known in the art.

This invention is shown by way of example.

EXAMPLE 1

Comparative

A vacuum residuum (100 parts) is subjected to propane deasphalting, yielding 34 parts deasphalted oil and 66 parts asphalt. The 34 parts deasphalted oil is treated with 58.5 parts furfural at an extract exit temperature of 180° F. This yields 21.7 parts refined oil and 12.3 parts primary extract. As a result, 21.7% of the vacuum residuum is recovered as refined oil.

With reference to the Drawing the material balance was calculated as follows:

| | | |
|---|---|---|
| Vacuum residuum | line 12 | 100 parts |
| Propane | line 22 | 800 parts |
| Deasphalted oil | line 23 | 34 parts |
| Asphalt | line 24 | 66.0 parts |
| Extraction solvent | line 32 | 58.5 parts |
| Primary raffinate | line 33 | 21.7 parts |
| Primary extract | line 34 | 12.3 parts |
| Secondary raffinate | line 43 | 0 parts |
| Secondary extract | line 44 | 0 parts |
| Added secondary raffinate | line 46 | 0 parts |
| Deasphalting temperature | | |
| Extraction temperature | 180° F. | |

EXAMPLE 2

Comparative

A process is operated according to U.S. Pat. No. 4,592,832 to Bristow et al.

A vacuum residuum (100 parts) is mixed with 17.5 parts primary extract and subjected to propane deasphalting, yielding 48.2 parts deasphalted lube oil and 69.3 parts asphalt.

The deasphalted lube oil is treated with 108 parts furfural at an extract temperature of 180° F. The solvent dosage must be increased over that of Example 1 when primary extract is recycled in order to recover the most lube oil. Deasphalted solvent refined lube oil of a quality (viscosity index) equal to that of Example 1 is recovered in an amount of 26.5 parts.

Primary extract amounting to 15.7 parts is recovered and stripped of solvent. This primary extract bypasses decanter 40 via line 35 and is mixed with additional primary extract in an amount of 1.8 parts brought in from tankage via line 46 to make up the 17.5 parts mixed with vacuum residuum.

As a result, 26.5% of the vacuum residuum is recovered as refined lube oil.

With reference to the Drawing the material balance was calculated as follows:

| | | |
|---|---|---|
| Vacuum residuum | line 12 | 100 parts |
| Total charge | line 18 | 117.5 parts |
| Propane | line 22 | 936 parts |
| Deasphalted oil | line 23 | 48.2 parts |
| Asphalt | line 24 | 69.3 parts |
| Extraction solvent | line 32 | 108 parts |
| Primary raffinate | line 33 | 26.5 parts |
| Primary extract | line 34 | 15.7 parts |
| Secondary raffinate | line 43 | 0 parts |
| Secondary extract | line 44 | 0 parts |
| Added primary extract | line 46 | 1.8 parts |
| Deasphalting temperature | | |

-continued

| | |
|---|---|
| Extraction temperature | 180° F. |

EXAMPLE 3

Best Mode

A vacuum residuum (100 parts) is mixed with 17.5 parts secondary raffinate and subjected to propane deasphalting, yielding 48.2 parts deasphalted lube oil and 69.3 parts asphalt.

The deasphalted lube oil is treated with 108 parts furfural at 180° F. The solvent dosage must be increased over that of Example 1 when secondary raffinate is recycled in order to recover the most lube oil. Deasphalted solvent refined of a quality (viscosity index) equal to that of Example 1 is recovered in an amount of 32.8 parts.

Primary extract amounting to 15.7 parts is sent to the decanter and cooled to 112° F. Secondary extract in an amount of 11.2 parts is stripped of solvent and sent to tankage. Secondary raffinate in an amount of 4.5 parts is recovered and stripped of solvent. Secondary raffinate in an amount of 13.0 parts is brought in from tankage via line 46 to make up the 17.5 parts mixed with vacuum residuum.

As a result 32.8% of the vacuum residuum is recovered as refined lube oil.

With reference to the Drawing the material balance was calculated as follows:

| | | |
|---|---|---|
| Vacuum residuum | line 12 | 100 parts |
| Total charge | line 18 | 117.5 parts |
| Propane | line 22 | 936 parts |
| Deasphalted oil | line 23 | 48.2 parts |
| Asphalt | line 24 | 69.3 parts |
| Extraction solvent | line 32 | 108 parts |
| Primary raffinate | line 33 | 32.8 parts |
| Primary extract | line 34 | 15.7 parts |
| Secondary raffinate | line 43 | 4.5 parts |
| Secondary extract | line 44 | 11.2 parts |
| Added secondary raffinate | line 46 | 13.0 parts |
| Deasphalting temperature | | |
| Extraction temperature | 180° F. | |
| Decanting temperature | 112° F. | |

While particular embodiments of the invention have been described, it will be understood, of course, that the invention is not limited thereto since many modifications may be made, and it is, therefore, contemplated to cover by the appended claims any such modifications as fall within the true spirit and scope of the invention.

What is claimed is:

1. In a process wherein a petroleum residuum is passed through first a deasphalting zone and second a solvent refining zone to yield a lubricating oil comprising the steps:

a. extracting the petroleum residuum with a low molecular weight alkane hydrocarbon solvent in the deasphalting zone to yield a deasphalted lube oil and asphaltic residue, b. separating the deasphalted lube oil and asphaltic residue, c. extracting the deasphalted lube oil of step b. with an extraction solvent in the solvent refining zone at an extraction temperature to yield an aromatics-lean primary raffinate comprising the lubricating oil and an aromatics-rich primary extract, d. separating the primary raffinate and the primary extract, wherein the improvement comprises:

e. cooling the primary extract of step d. to a temperature 10° F. to 120° F. below the extraction temperature, thereby forming an aromatics-lean secondary raffinate and an aromatics-rich secondary extract, f. separating the secondary raffinate and secondary extract, g. passing the secondary raffinate of step f. to the deasphalting zone, thereby increasing the yield of lubricating oil from the petroleum residuum.

2. The process of claim 1 wherein in step c. the extraction temperature is 75° F. to 375° F. and solvent to deasphalted lube oil dosage is in the range of 50 vol % to 500 vol %.

3. The process of claim 1 wherein step e. additionally comprises admixing said primary extract with antisolvent.

4. The process of claim 1 wherein step e. additionally comprises admixing said primary extract with 0.1 vol % to 10 vol % antisolvent.

5. The process of claim 1 wherein step e. additionally comprises admixing said primary extract with an antisolvent selected from the group consisting of water, glycols and alcohols.

6. The process of claim 1 wherein step e. additionally comprises admixing said primary extract with an antisolvent comprising water.

7. The process of claim 1 wherein step e. additionally comprises admixing said primary extract with 0.1 vol % to 10 vol % of an antisolvent selected from the group consisting of water, glycols and alcohols.

8. The process of claim 1 wherein step e. additionally comprises admixing said primary extract with 0.1 to 10 vol % of an antisolvent comprising water.

9. The process of claim 1 wherein in step c. the extraction solvent is selected from the group consisting of N-methyl-2-pyrrolidone, furfural, phenol and water mixtures thereof.

10. The process of claim 1 wherein in step c. the extraction solvent is furfural.

11. The process of claim 1 wherein in step a. the alkane hydrocarbon solvent is propane.

12. The process of claim 1 wherein in step a. extracting is carried out at a temperature of 100° F. to 250° F. and a pressure of 200 psig to 1000 psig and a solvent to residuum of 400 vol % to 1000 vol %.

* * * * *